US005343723A

United States Patent [19]

Miller et al.

[11] Patent Number: 5,343,723

[45] Date of Patent: Sep. 6, 1994

[54] COMBINATION LOCK

[75] Inventors: J. Clayton Miller, Nicholasville; Thomas Jasper, Bryantsville, both of Ky.

[73] Assignee: Lockmasters, Inc., Nicholasville, Ky.

[21] Appl. No.: 940,133

[22] Filed: Sep. 3, 1992

[51] Int. Cl.[5] ..... E05B 37/04

[52] U.S. Cl. ..... 70/303 A; 70/314; 70/333 R; 70/321; 70/1.5

[58] Field of Search ..... 70/332, 303 R, 303 A, 70/DIG. 9, 33 R, 314, 321, 322, 1.5, 1.7

[56] References Cited

U.S. PATENT DOCUMENTS

| | | | |
|---|---|---|---|
| 2,256,827 | 9/1911 | Fowler | 70/1.5 |
| 2,925,726 | 2/1960 | Miller | 70/1.5 |
| 3,077,099 | 2/1963 | Fitchett | 70/1.5 |
| 3,906,761 | 9/1975 | Swaim | 70/303 A |
| 4,359,883 | 11/1982 | Bechtiger et al. | 70/303 A |
| 4,420,955 | 12/1983 | Marold | 70/303 A |
| 4,708,006 | 11/1987 | Hodgson | 70/303 R |
| 4,910,981 | 3/1990 | Gartner | 70/303 A |
| 5,095,724 | 3/1992 | Lainhart | 70/303 A |
| 5,257,519 | 11/1993 | Miller, III . | |

FOREIGN PATENT DOCUMENTS

| | | | |
|---|---|---|---|
| 89031460 | 9/1990 | Australia | 70/333 R |
| 9211430 | 7/1992 | PCT Int'l Appl. | 70/303 A |

*Primary Examiner*—Peter M. Cuomo
*Assistant Examiner*—D. M. Boucher
*Attorney, Agent, or Firm*—Lowe, Price, LeBlanc & Becker

[57] ABSTRACT

In accordance with one aspect of the invention, a kicker arm-pawl lock mechanism rotates a number one wheel of a combination lock a predetermined distance to require resetting each number of a combination during lock manipulation. A drive cam-travel arm and bolt lock mechanism assures complete scrambling of the combination by requiring rotation of all wheels prior to bolt extension into a locked position. Another aspect of the invention includes a lock lever and drive cam mechanism which requires opening of the combination lock once a combination has been correctly dialed. A lock lever and pivoting pawl lock mechanism prevents lockout conditions by diverting forces applied to the combination lock bolt to the lock casing rather than the lock lever.

22 Claims, 8 Drawing Sheets

COMBINATION LOCK

FIELD OF THE INVENTION

The invention relates to an improved combination lock and, in particular, a plurality of lock mechanisms which deter the use of automatic dialers, prevent lockout conditions, scramble the combination prior to locking and require opening once the combination has been dialed.

BACKGROUND ART

In the prior art, various types of combination locks have been proposed for security purposes. With reference to FIG. 1, one type of prior art combination lock is generally designated by the reference numeral 10 and is seen to include a lock casing 1 and a combination lock assembly 3 disposed therein. The combination lock assembly includes a dead bolt 5 having an outer face 7 thereon. In this lock, three wheels are provided, 11, 13 and 15. As can be seen from FIG. 1, wheel 15 includes a gate 17 formed therein. Although not shown, each of the wheels 11 and 13 also includes a gate therein.

A lock lever 9, connected at one end to the dead bolt 5, includes a nose 19 and an end face 21 at the opposite end. Extending outwardly from the lock lever 9 near the nose 19 is a fence 23 which is adapted to enter the gates of the wheels when they are aligned. The casing 1 also includes a lever stop 25 preventing further travel of the lock lever and dead bolt inwardly of the lock casing 1.

The combination lock assembly also includes a drive cam 27 having a drive cam gate 29. A spindle 31 extends through the center of each of the wheels and drive cam 27. The opposite end of the spindle is connected to a combination dial (not shown). The spindle transmits rotational movement of the combination dial to the drive cam and wheels to obtain the correct combination.

One problem associated with these types of combination locks includes lockout conditions wherein the lock lever 9 is prevented from dropping into the drive cam gate 29 when the gates of the wheels are aligned. One reason for a lockout condition is an excessive force applied to the face 7 of the dead bolt 5 which forces the face 21 of the lock lever 9 against the lever stop 25. Wedging the face 21 of the lock lever 9 against the lever stop prevents the lock lever nose 19 from dropping into the drive cam gate 29 when the combination is dialed.

Accordingly, a need has developed to provide an improved combination lock which avoids lockout conditions caused by lock lever jamming as a result of a force applied to the dead bolt.

Another disadvantage associated with these types of combination locks includes ease of unauthorized entry by manual manipulation. Specifically, when the combination lock is locked such that the dead bolt 5 extends into a strike, not all of the wheels 11, 13, and 15 may be fully rotated before the dead bolt is extended. Extension of the dead bolt 5 is performed by counter-clockwise rotation of the combination dial (not shown). This counter-clockwise rotation results in a clockwise rotation of the drive cam 27 as viewed in FIG. 1 and sliding of the lock lever nose 19 out of the drive cam gate 29 so as to rest on the circumferential surface of the drive cam 27.

However, if a user does not rotate the combination dial counter-clockwise a sufficient number of turns or, alternatively, merely gives the combination dial a spin, only one or two of the three wheels may rotate such that one or more gates may still be aligned with the fence 23. In this situation, the combination dial can be more easily manipulated since only one or two wheels have to be rotated to achieve the correct combination.

One type of prior art combination lock, i.e., a KVE Kromer lock, requires the wheel farthest away from the drive cam, commonly referred to as the number one wheel, to rotate before the dead bolt extends. In this lock, the lock lever is connected to the dead bolt via a pivoting knuckle arrangement. Thus, when the lock lever exits the drive cam gate, the knuckle pivots such that the lock lever can rise up out of the drive cam gate without extending the bolt into a locked position. Upon rotation of the number one wheel through counter-clockwise rotation of the combination dial, a mechanical arrangement between the number one wheel and lock lever causes the lock lever to move downwardly and engage a protrusion on the drive cam. Further rotation of the combination dial causes the protrusion to force the lock lever and dead bolt outwardly to positively lock the combination lock.

Because of the complex mechanical arrangement of the Kromer lock, a need has developed to provide a simpler and more direct extension of a combination lock bolt in relation to movement of the number one wheel.

Another drawback of the types of prior art locks of FIG. 1 is the ability of a user to dial a combination, but then not open the lock by retraction of the dead bolt 5. A correctly dialed lock but unopened lock facilitates detection of the combination by unauthorized users. In view of this deficiency, a further need has developed in the prior art to provide a combination lock which requires opening of the combination lock once a combination has been correctly dialed.

Another disadvantage of these types of prior art locks is the ability for an automatic dialing machine to manipulate the combination dial in a sequential manner until the lock is opened. Automatic dialing machines are known that seek a correct combination by first setting the number one wheel, then setting the number two wheel and sequentially checking the combination for each combination dial number for the third number. An auto-dialing machine can go through a million theoretical combinations in approximately 30 hours. In view of this, a need has developed to provide combination locks which prevent or make it more difficult for manipulation by automatic dialing machines.

The present invention provides improved combination lock mechanisms which overcome the disadvantages in the prior art. In one aspect of the invention, a combination lock mechanism extends the time required for an automatic dialing machine to manipulate a combination lock by at least a factor of four.

Another combination lock mechanism in accordance with a second aspect permits a lock lever to extend or retract a lock bolt while preventing transmission of force from a combination bolt to a lock lever to cause a lockout condition.

In accordance with another aspect of the invention, an improved combination lock mechanism requires full rotation of all the wheels prior to extension of the combination bolt in a simple but effective manner. A still further aspect of the present invention implements a novel arrangement of a drive cam and lock lever which requires the combination lock to be opened once the combination has been dialed.

SUMMARY OF THE INVENTION

Accordingly, a first object of the present invention is to provide improved combination lock mechanisms for use with combination dial locks.

A further object of the present invention is to lengthen the time required for automatic dialing machines to determine the combination of a combination lock to an unacceptable length so as to deter surreptitious entry.

Another object is to avoid lockout conditions in a combination lock mechanism.

A still further object of the present invention is to provide a simple and effective mechanism requiring rotation of all the wheels of a combination lock assembly prior to extension of the bolt to a locked position.

Another object is to provide a combination lock mechanism which requires that the combination lock bolt be retracted once the combination has been dialed by a user.

Other objects and advantages of the present invention will become apparent as a description thereof proceeds.

In satisfaction of the foregoing objects and advantages, the present invention is particularly adapted for use with a combination lock having a lock casing and a lock cover, a combination dial attached to one end of a spindle extending through the lock casing, a drive cam attached to the other end of the spindle, and a plurality of wheels rotatably mounted on the spindle. Each wheel has a gate, a lock lever having a nose, and a bolt adapted to be extended or retracted by translation of the lock lever, such that the spindle is able to be longitudinally translated for checking a combination.

In a first aspect, the combination lock mechanism comprises means for translating longitudinal movement of the spindle into a rotational movement and means for transmitting the rotational movement to one of the wheels adjacent the lock casing such that checking of an incorrect combination scrambles the combination. In particular, the combination lock mechanism includes a kicker arm and kicker pawl assembly and a number one wheel having a geared circumferential portion. The kicker arm and kicker pawl are designed to rotate such that the kicker pawl engages the number one wheel and rotates it a predetermined distance to scramble the combination when the combination is checked.

In another aspect of the invention, a combination lock mechanism comprises a fully radiused post extending from the lock lever nose, and means associated with the drive cam for engaging and holding the fully radiused post when a correct combination is dialed until the combination lock is opened by retraction of the bolt and for releasing the post when the combination lock is to be locked by extension of the bolt. A drive cam including a slotted opening receives the fully radiused post. The drive cam also includes a through opening which secures the post until the bolt is retracted. The drive cam slotted opening also includes ramp features to facilitate releasing of the radiused post when the bolt is retracted during locking of the combination lock.

In a further aspect of the invention, a combination lock mechanism comprises a member pivotally mounted to the bolt, and means attached to one of the plurality of wheels adjacent the lock casing for engaging the member to extend the bolt into a locked position. A further means is associated with the bolt for permitting extension of the lock lever such that each of the plurality of wheels can rotate to scramble the combination prior to extension of the bolt by engagement between the member and the means for engaging the member. In particular, a drive cam is attached to the number one wheel, the drive cam rotating to engage the member and extend the bolt only after all wheels of the combination lock have been rotated. The bolt includes a sliding plate member which permits removal of the fence of the lock lever from the gates and extension of the lock lever without extension of the bolt to the locked position.

Another aspect of the invention comprises a combination lock mechanism which prevents the lock lever from hanging-up and causing a lockout condition. This combination lock mechanism includes means associated with the bolt for permitting limited extension of the lock lever without extending the bolt. Another means transmits force applied to an end face of the bolt when extended to the lock casing without passing the force and to the lock lever and consequently positioning the lock lever in an inoperable position. In particular, the bolt includes a pair of pivoting pawls which pivot between an inward and outward position. The outward position facilitates transmission of force from the dead bolt to the lock casing rather than to the lock lever. A sliding plate assembly in combination with the bolt pivots the pawls outwardly during bolt extension while permitting inwardly pivoting movement of the pawls during bolt retraction.

BRIEF DESCRIPTION OF DRAWINGS

Reference is now made to the Drawings accompanying the application wherein.

DESCRIPTION OF THE PREFERRED EMBODIMENTS

Figure 1:
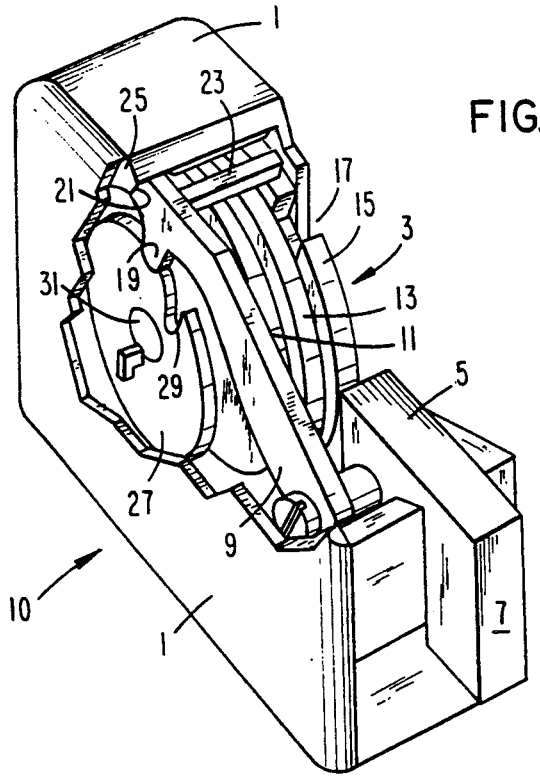
FIG. 1 PRIOR ART
FIG. 1 is a perspective view of a prior art type combination lock.
Figure 2:
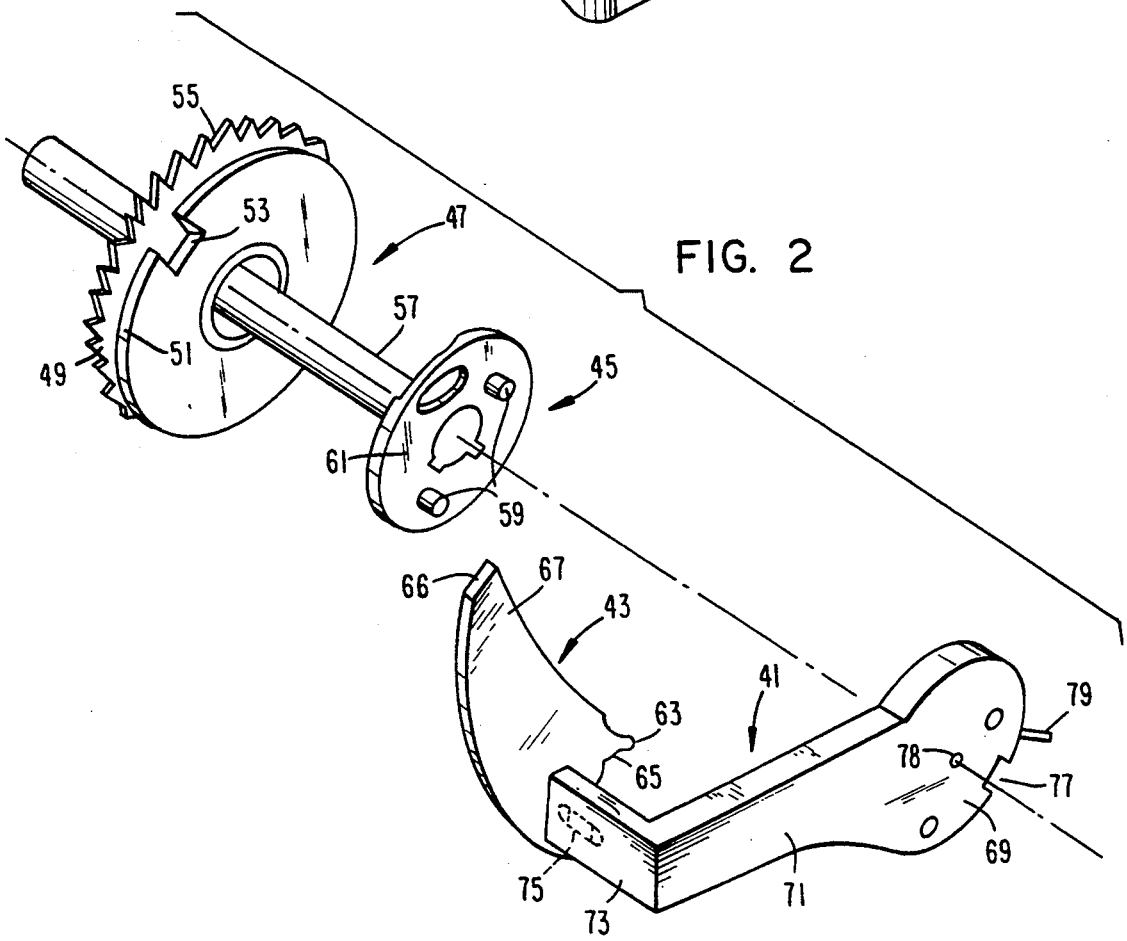
FIG. 2 is an exploded view of certain components of the kicker arm-pawl lock mechanism.
Figure 3:
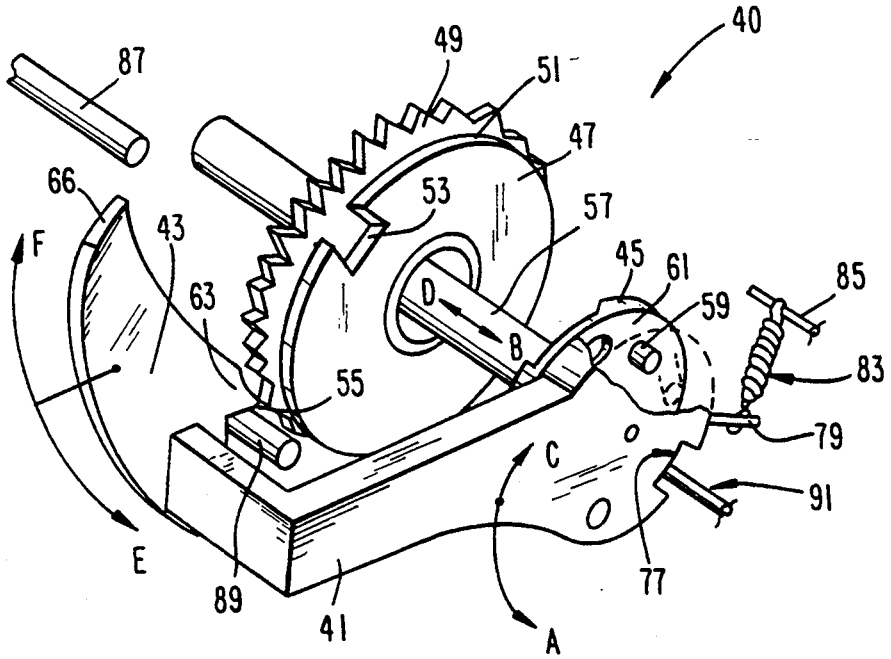
FIG. 3 shows the kicker arm-pawl lock mechanism in a first position.

With reference now to FIGS. 2 and 3, a kicker arm and pawl lock mechanism is generally designated by the reference numeral 40 and seen to include a kicker arm 41, a pawl 43, a drive cam 45 and a wheel 47 having a surrounding gear portion 49. The gear portion 49 is disposed adjacent a circumferential surface 51 having a gate 53 therein. The gear portion 49 includes a plurality of teeth 55 which are designed to receive a portion of the pawl 43, as will be described hereinafter. The wheel 47 corresponds to a number one wheel for a combination lock, but could be any one of them.

A spindle 57 is threadably connected to the drive cam 45 having a pair of pins 59 extending from cam face 61. The pawl 43 includes an ear 63 having a bottom face 65, and a bevelled face 66 at a tip portion 67 of the pawl.

The kicker arm 41 includes a body portion 69, with a first leg 71 and a second leg 73 that extend from leg 71. The pawl 43 is mounted to leg 73 by a screw 75 or pivot such that the pawl 43 can rotate about the screw axis.

Figure 4:
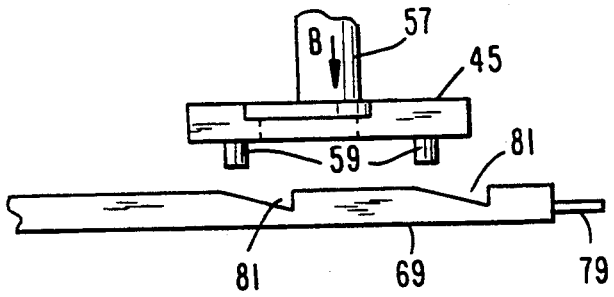
FIG. 4 is a schematic illustration of the drive cam and pins in relation to the kicker arm body and ramps therein.

One end of the kicker arm body portion 69 is formed with a slot 77 and a pin 79 extends from the surface as shown. There also is a pair of ramp slots 81 formed in the inner surface of the body 69, as shown in FIG. 4. The ramp slots 81 are positioned to receive the pins 59 of the drive cam 45 during operation of the kicker arm-pawl mechanism.

With reference to FIG. 3, a spring 83 is connected between to the pin 79 and a pin 85. Although not shown, it should be understood that the pin 85 extends from the lock cover to provide a stationary point for attachment of the spring 83.

Furthermore, the pins 87 and 89 extend from the lock casing. These pins control pivoting of the pawl 43. Another pin 91 extending from the lock cover (not shown) into the slot 77 of the kicker arm body 69 acts as a stop to control rotational movement of the kicker arm.

The kicker arm 41 is supported by the pin 91 residing in the slot 77 and a fastener extending through the lock cover into the threaded opening 78, as in FIG. 2. The fastener, e.g. a screw, loosely fits through the lock cover to support and permit rotation of the kicker arm 41. Of course, other known types of fastening or securing the kicker arm for rotation and engagement with the drive cam may be employed.

In operation, the spindle 57 first is biased toward the combination dial. The combination dial is pushed in to check whether the combination dialed is the correct one. This inward movement of the combination dial longitudinally translates the spindle 57 in the direction indicated by the arrow B in FIG. 4. Movement of the spindle 57 in the direction B forces the pins 59 of the drive cam 45 into the ramped slots 81. This longitudinal translation of the spindle 57 rotates the kicker arm 41 due to the pins 59 engaging the ramp slots 81. Rotation of the kicker arm 41 is counter-clockwise as shown by the arrow C in FIG. 3, directing the ear 63 of the pawl 43 into engagement with a tooth 55 on number one wheel 47. It should be understood that the travel of the kicker arm generally corresponds to the length that the pins travel in the ramped slots 81.

After the combination has been checked, the combination dial is released and the spindle 57 translates outwardly, as shown by the arrow D in FIG. 3. This translational movement of the spindle 57 disengages the pins 59 from the ramp slots 81 in the kicker body portion 69. The spring 83 then biases the kicker arm 41 in the direction A (FIG. 3) or counter-clockwise. Counter-clockwise rotation of the kicker arm 41, with the ear 63 still engaged in the tooth 55, rotates the number one wheel 47 of the combination lock. Thus, each time the combination is checked, the kicker arm-pawl lock mechanism rotates the number one wheel a predetermined distance. If an automatic dialing machine is attempting to determine a combination sequence, the automatic dialing machine must reset the entire combination each time the combination is checked, lengthening the time required to determine a combination.

During spring biasing rotation of the kicker arm 41, the face 65 of the ear 63 contacts the pin 89. Since the pin 89 is stationary, the pawl 43 pivots counter-clockwise (E), so as to disengage the ear 63 from the tooth 55. Thus, the ear 63 is again primed for engagement with another tooth on the gear portion 49 once another combination is checked.

The pin 87 is positioned so as to engage the face 66 of the pawl 43 to pivot the pawl 43 clockwise as indicated by the arrow F. Should the kicker arm 41 and pawl 43 rotate in a clockwise direction the pin 87 pivots the pawl 43 clockwise so as to disengage the pawl ear 63 from a tooth. Likewise, the pin 89 disengages the ear 63 from a given tooth when the pawl and kicker arm are rotated counter-clockwise.

Figure 5:
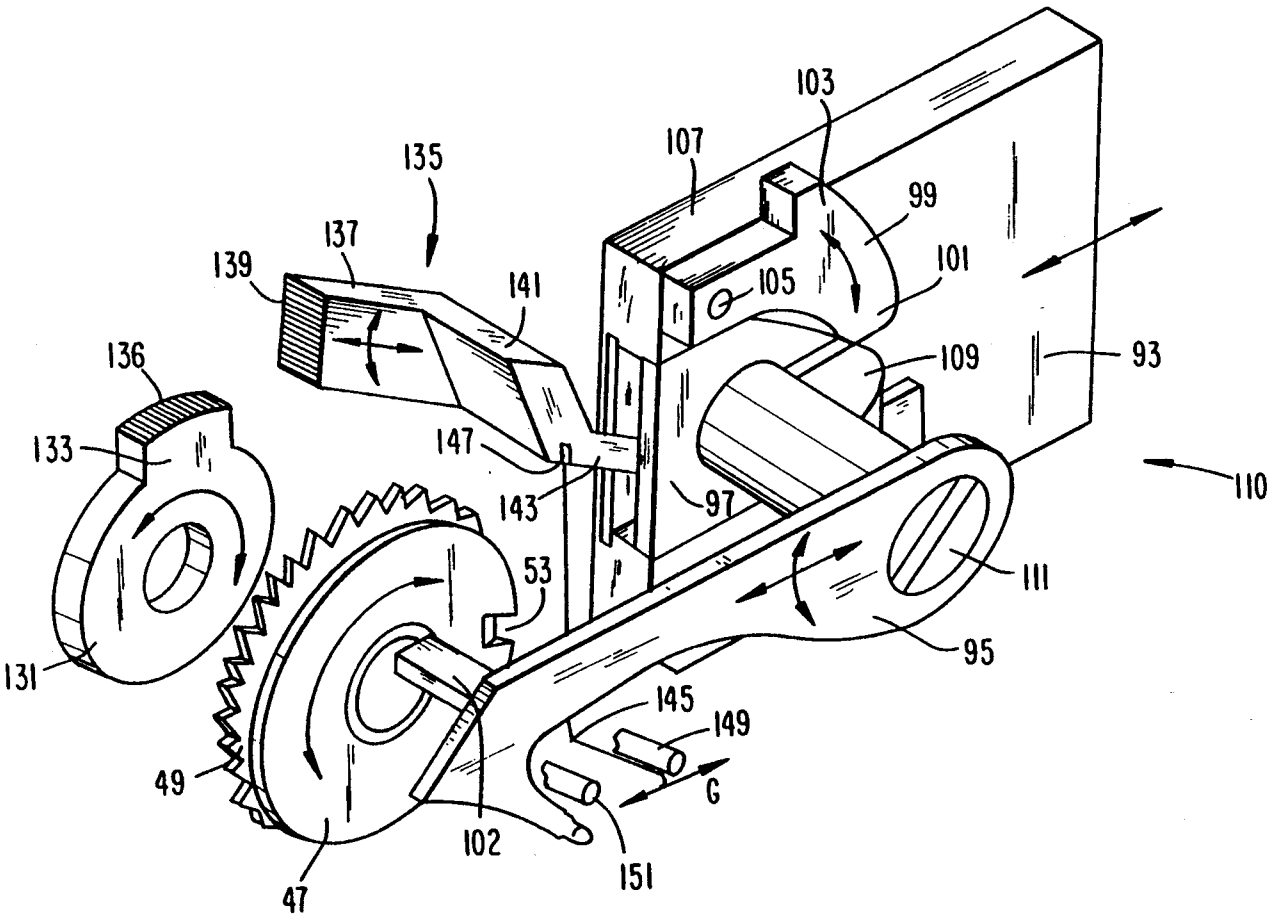
FIG. 5 is a perspective view of components of a combination lock with the bolt in an extended position with lock lever and bolt arrangement preventing lockouts. This figure also depicts a number one wheel drive cam and travel arm-bolt arrangement for scrambling the combination.
Figure 6:
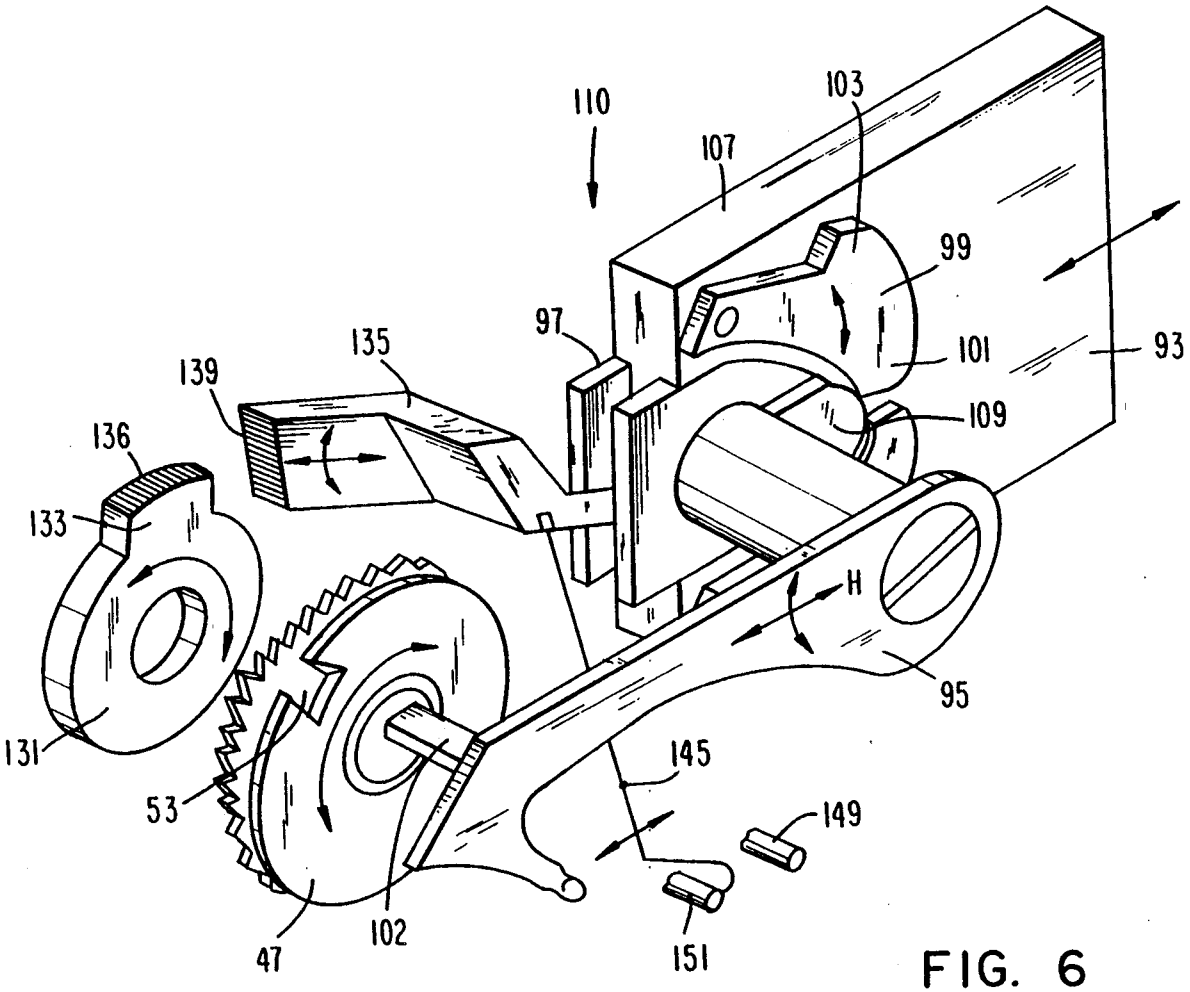
FIG. 6 corresponds to FIG. 5, with the bolt in the retracted position.
Figure 7:
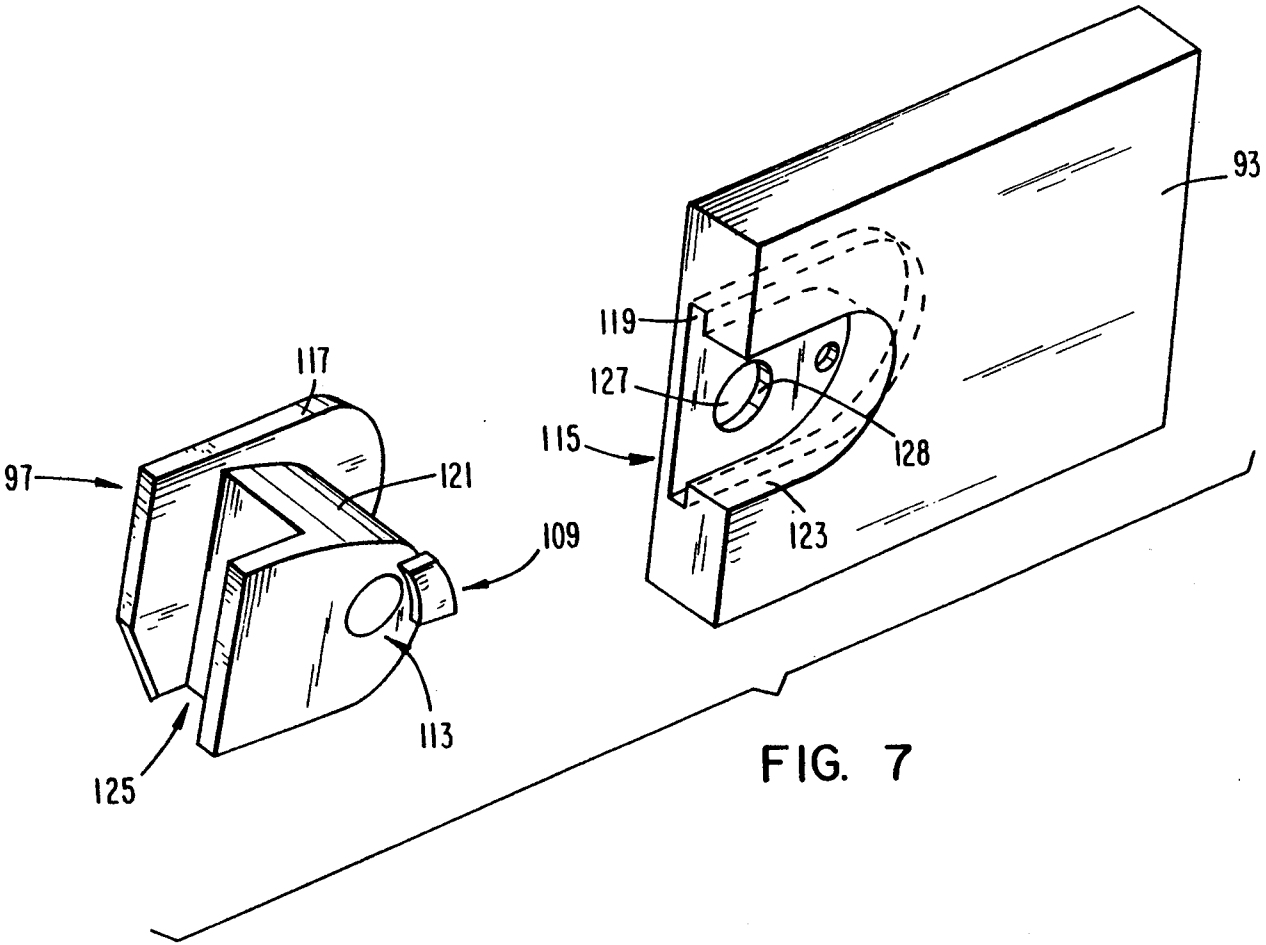
FIG. 7 shows the bolt and sliding plate insert of FIG. 5, exploded for greater detail.

FIGS. 5–7 illustrate two additional aspects of the present invention. The first aspect includes the lock lever and pawl mechanism which prevent lockout conditions for a combination lock. The lock lever and pawl mechanism, generally designated by the reference numeral 110, includes a bolt 93, lock lever 95 and a sliding plate insert 97. The bolt 93 pivotally supports a pair of pawls 99. Each pawl has a first ear portion 101 and a second generally opposed ear portion 103. Each pawl is pivotally mounted to the bolt 93 by a pivot pin 105. As will be described hereinafter, it should be understood that the pawls 99 are friction biased inwardly or toward the longitudinal axis of the bolt 93. Alternatively, the pawls 99 can be mounted within a slot in the bolt body rather than on an outer face thereof.

Figure 11:
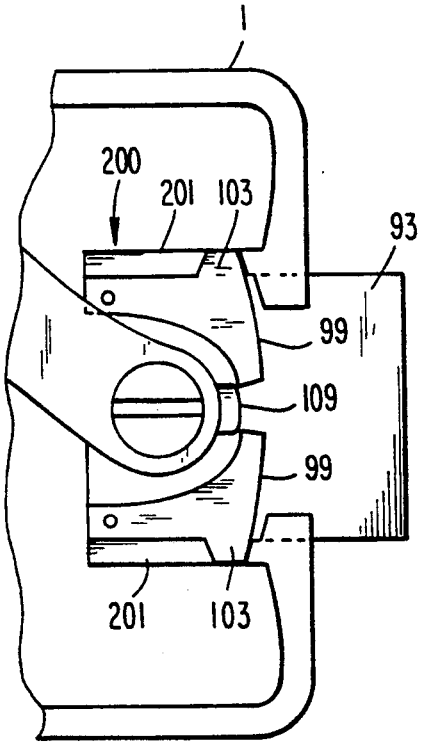
FIGS. 11 and 12 depict motion of certain components of the lock lever and bolt arrangement.
Figure 12:
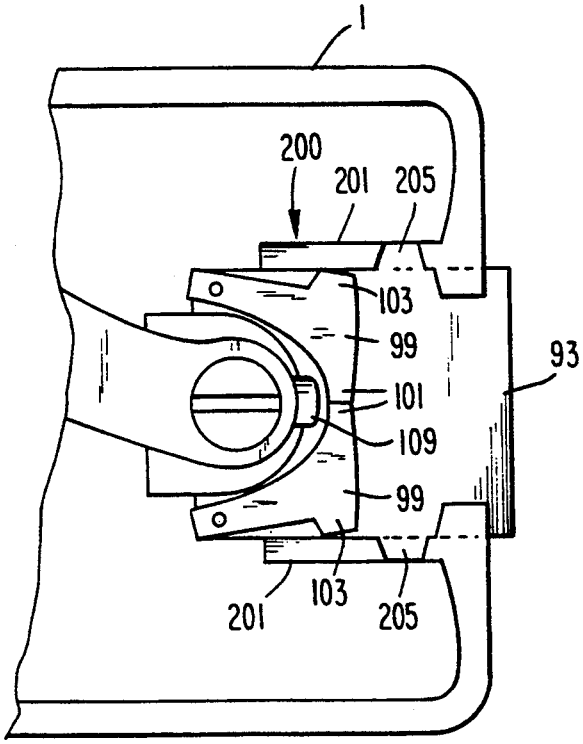

With reference now to FIGS. 11 and 12, the lock has a bolt slideway designated by the reference numeral 200 which includes upper and lower members 201 which guide the bolt 93 during extension and retraction. Each of the members 201 has a slot 205. When the bolt 93 is extended as shown in FIG. 11, the ear portions 103 of the pawls 99 engage the slots 205. Thus, a force on the end face of the bolt 93 is transmitted to the lock casing by the force being transmitted from the ear portions 103 to the inner surfaces of the slot 205.

In the retracted position, the pawls 99 are pivoted toward the longitudinal axis of the bolt 93 while the stop 109 is withdrawn from between the ear portions 101. The pivoting travel of the pawls 99 will be more fully described in conjunction with the travel of the stop 109 hereinafter.

The sliding plate insert 97 includes a pawl stop 109 designed to engage the pawl ear portions 101 during bolt movement also. The lock lever 95 is threadably connected to the sliding plate insert 97 via the fastening bolt 111.

With reference to FIG. 7, the sliding plate insert 97 has a first flange 117 engaging the slot 119 of the opening 115 in the bolt 93. The sliding plate insert 97 also includes a through opening 113 receiving the bolt 111 of the lock lever 95. Aligned with the through opening 113 is an elongated slot 127 in the bolt 93. The elongated slot 127 permits limited travel of the sliding plate insert within the opening 115. The inner surface 128 of the elongated slot 127 functions as a stop to prevent further travel of the sliding plate insert 97. The sliding plate insert 97 also has a curved face 121 to engage the curved face 123 of the opening 115 during longitudinal movement of the sliding plate insert 97 in the bolt opening 115. The sliding plate insert also includes a slot 125 which permits pivotal attachment of the travel arm 135, as described later.

In operation, referring to FIG. 5, with the bolt 93 in the extended position, the sliding plate insert 97 is fully engaged in the slot 115 such that the pawl stop 109 contacts the ears 101 of the pawls 99. The pawl stop 109 pivots the pawls 99 outwardly such that the ears 103 engage the slots 205, see FIG. 11. In this configuration, a force applied to the face of the bolt 93 is transmitted from the bolt to the slot surface via the pawls 103. A direct force is not applied to the lock lever to cause the lock lever to hangup in an inoperable position.

When the combination lock is opened, i.e., with the fence 102 dropping into the gates 53 of the wheels to permit retraction of the bolt 93 through translation of the lock lever 95, the sliding plate insert 97 retracts initially until the lock lever bolt 111 contacts the inner edge of the through hole 127, as in FIG. 7. Further translation of the lock lever 95 results in retraction of the bolt 93. With the sliding plate insert 97 retracting (FIG. 6) the pawls 99 can pivot inwardly as a result of the bolt 93 retracting such that the ears 103 of the pawls are disengaged from the slots 205.

By the arrangement between the lock lever 95, the sliding plate insert 97, the pawls 99, slots 205 and pawls stop 109, hangups of the lock lever or lockout conditions are avoided.

With reference again to FIGS. 5 and 6, the lock mechanism which requires scrambling of the combination and full rotation of the number one wheel will now be described. A drive cam 131 is adjacent the number one wheel 47 and between the wheel 47 and the lock casing (not shown). The drive cam includes a step 133 having face 136. The face 136 may be serrated or, alternatively, smooth surfaced. It should be understood that although the drive cam 131 in the embodiment shown is separated from the number one wheel 47, the drive cam 131 can be an integral part of the wheel 47. In an alternative embodiment, the drive cam 131 may be attached to the wheel 47 using fasteners such as screws or the like. In either case, the drive cam 131 is adjacent the geared portion 49 of the wheel 47.

A travel arm 135 includes a first leg 137 having an end face 139. The end face 139 may be serrated to facilitate engagement with the face 163 or, alternatively, may be smooth surfaced. The leg 137 is generally aligned with the drive cam 131 to permit engagement between the face 136 of the step 133 and the face 139. A second leg 141, extending from the leg 137, is angled with respect to the face 139 so as to avoid contact with the number one wheel 47. A stem 143 extends from the leg 141 and is pivotally connected to the bolt 93. Although the stem in FIGS. 5 and 6 is pivotally connected to the slide member 97, the stem may also be pivotally connected to a bolt without the lock lever and pawl mechanism described above. The pivotal connection of the stem 143 to the sliding plate 97 permits the travel arm 135 to pivot upwardly or downwardly.

Pivoting of the travel arm is controlled by a travel spring 145 rigidly connected at point 147 to the travel arm 135. It should be understood that the travel spring 145 generally forms a T-configuration with the travel arm 135.

Pins 149 and 151 extend from the lock casing to control pivoting of the travel arm 135 as will be described hereinafter.

With reference to FIG. 5, the bolt 93 is in the extended position. During extension of the bolt 93, the travel spring 145 moves in the direction designated by the arrow G to contact the pin 149. Contact between the travel spring 145 and pin 149 pivots the travel arm upwardly. Thus, when the bolt is fully extended in the locked position, the travel arm 135 is positioned to avoid engagement with the drive cam 131 during rotation of the number one wheel 47. The manner in which the drive cam 131 engages the travel arm 135 to extend the bolt will be described hereinafter.

With reference to FIG. 6, the bolt 93 is in the retracted position. During retraction of the bolt 93, the travel spring 145 moves in the direction of the arrow designated by the letter F so as to contact the pin 151. Contact between the travel spring 145 and the pin 151 causes the travel arm 135 to pivot downwardly. In the downward position, the travel arm 135 is located such that the face 139 can engage the geared face 136 of the drive cam 131.

Once the combination lock has been opened by retraction of the bolt 93, and when viewing the combination dial, rotation of the dial counter-clockwise raises the lock lever and lever nose out of the gate 53 and translates the lock lever in the direction specified by the arrow H. To enable the bolt 93 to be fully extended, the number one wheel 47 must be rotated such that the face 136 of the drive cam step 133 engages the face 139 of the travel arm, imparting motion to the travel arm depicted by the arrow I. The travel arm 135 imparts pressure on screw 111 which moves slide member 97 toward a locking position. Stop 109 puts a forward and outwardly motion on surfaces 101 of the paws, causing the bolt 93 to move to a locked position. When surface 103 of the paws reach a slot in the bolt slideway 200, they are able to pivot outwardly into the slots 205, thereby allowing stop 109 to move between surfaces 101 of the paws to block bolt retraction. By requiring rotation of the number one wheel prior to full extension of the bolt 93, scrambling of the entire combination is completed prior to locking the combination lock.

It should be understood that, for this aspect of the invention, the pivoting pawls are not required. Thus, the lock lever and sliding plate member as described above can be used as a combination bolt to scramble a combination fully prior to bolt extension. Moreover, other configurations such as pins or the like extending from the lock casing may be substituted for the slots in the bolt slideway.

Figure 9:
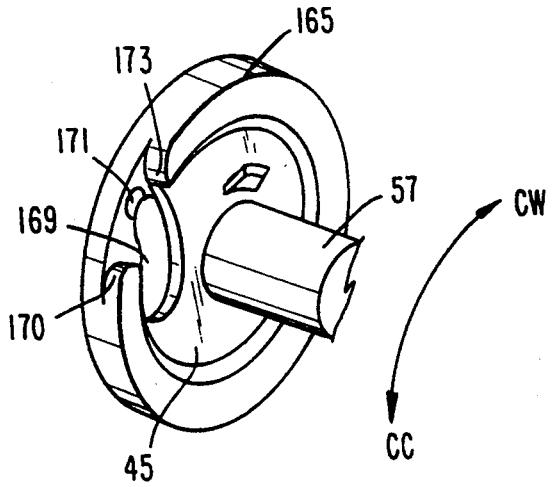
FIG. 9 is a rear perspective view of the drive cam.
Figure 10:
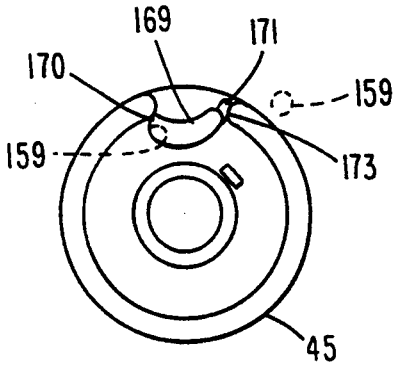
FIG. 10 is a rear view of the drive cam depicting movement of the lock lever post during lock operation.
Figure 8:
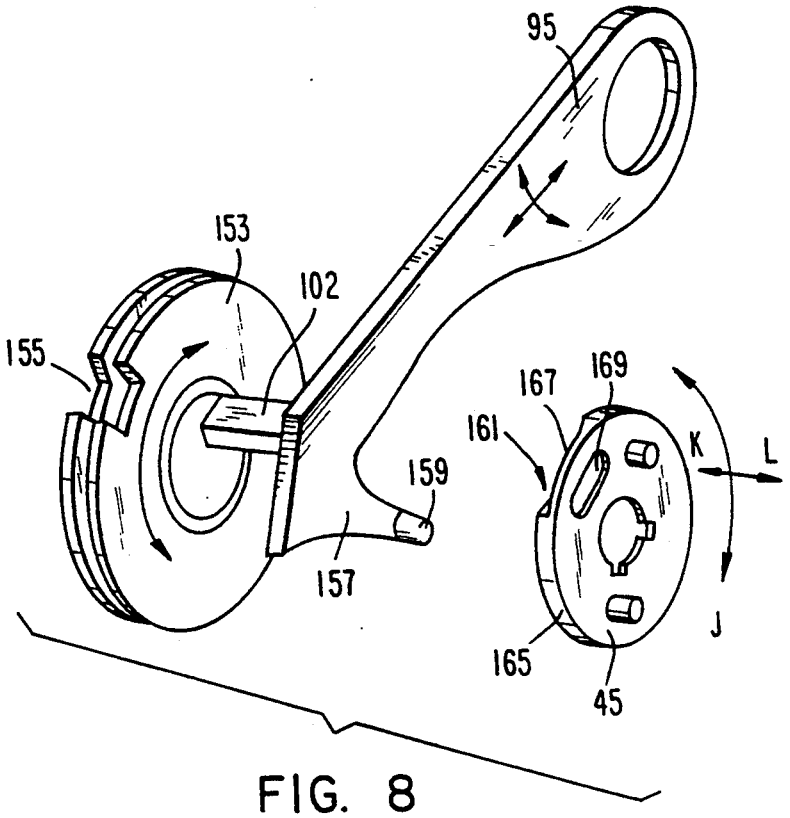
FIG. 8 is a perspective view of the drive cam and lock lever arrangement, exploded for greater detail.

In another aspect of the invention, a unique lock lever and drive cam mechanism is disclosed that requires opening of the combination lock once the correct combination has been dialed. With reference now to FIGS. 8–10 , a lock lever 95, the drive cam 45 and pair of exemplary wheels 153 are shown. Further, the fence 102 is shown aligned with the gates 155 of the wheels 153. The lock lever nose 157 includes a fully radiused or ramped post 159 extending from a distal end thereof. The post 159 is rounded to facilitate travel of the post as will be described hereafter.

The drive cam 45, includes a ramped slot opening 161. The ramped slot opening 161 includes a ramp portion 173 which facilitates disengagement of the lock lever nose 157 and post 159 from the drive cam 45 when the drive cam is rotated in a clockwise direction as indicated by the arrow J.

The drive cam 45 has a circumferential outer face 165. Except by the region of the ramp slot opening 161, the outer face 165 approximates the thickness of the drive cam 45. Adjacent the ramp slot opening 161 is an outer face portion 167 of decreased width. The ramp opening 161 and face 167 cooperate during operation of the lock lever nose and drive cam, as will be described hereinafter.

The drive cam 45 also includes a through opening 169 which is positioned within the recess ramped slot created by the opening 161. Again, and as indicated by the arrows K and L, the drive cam 45 translates in either direction K or L when a combination dial is pushed inwardly or released. During manipulation of a combination dial, rotation of the spindle causes the drive cam to rotate either clockwise or counter-clockwise. During rotation of the drive cam 45, the fully radiused post 159 of the lock lever nose 157 travels along the faces 165 and 167 of the drive cam 45. When the proper combination has been dialed, the gates 155 of the wheels 153 align with the fence 102 such that the fence can drop within the gates 155. During lowering of the lock lever fence 102 into the gates 155, the ramped slot opening 161 is aligned such that fully radiused post 159 of the lock lever nose 157 can drop within the slot 161. This action occurs when the combination is checked and the spindle and drive cam are translated in the direction L.

During translation of the drive cam 45, the post 159 clears the surface 167 and drops into the slot 161. Upon release of the combination dial, the spindle and drive cam translate in the direction K such that the fully radiused post 159 engages the through opening 169. Thus, upon release of the combination dial and prior to rotation of the combination dial, the lock lever becomes securely engaged in the drive cam. With the lock lever securely engaged in the drive cam, the only rotation permitted by the combination dial is clockwise, when viewed from the dial, to retract the combination lock bolt. The combination dial cannot be rotated counter-clockwise since the lock lever is engaged in the drive cam and cannot be raised to permit free rotation of the drive cam and spindle.

Once the lock has been opened, clockwise rotation of the drive cam 45 releases the lock lever nose 157 and lock lever post 159 from the drive cam to position the fully radiused post 159 on the surfaces 165 and 167 of the cam 45.

With reference to FIGS. 9 and 10, the drive cam side facing the lock lever 95 is shown. From this view, a ramp portion 171 slopes inwardly towards the ramp 173. The ramp 171 facilitates the fully radiused post 159 from ramping out of the through hole 169 onto the ramp 173 and the outer circumferential surface 165 of the drive cam 45.

With particular reference to FIG. 10, the fully radiused post 159 is engaged under the lip 170 of the slot 169 during opening of the combination lock. The lip 170 facilitates holding of the post 159 in the through opening 169 during lock opening. FIG. 10 also shows the motion of the post 159 when the combination lock dial is turned counter-clockwise to lock the lock and disengage the post 159 from the slot 169 to the outer surface 165.

Figures 13, 14:
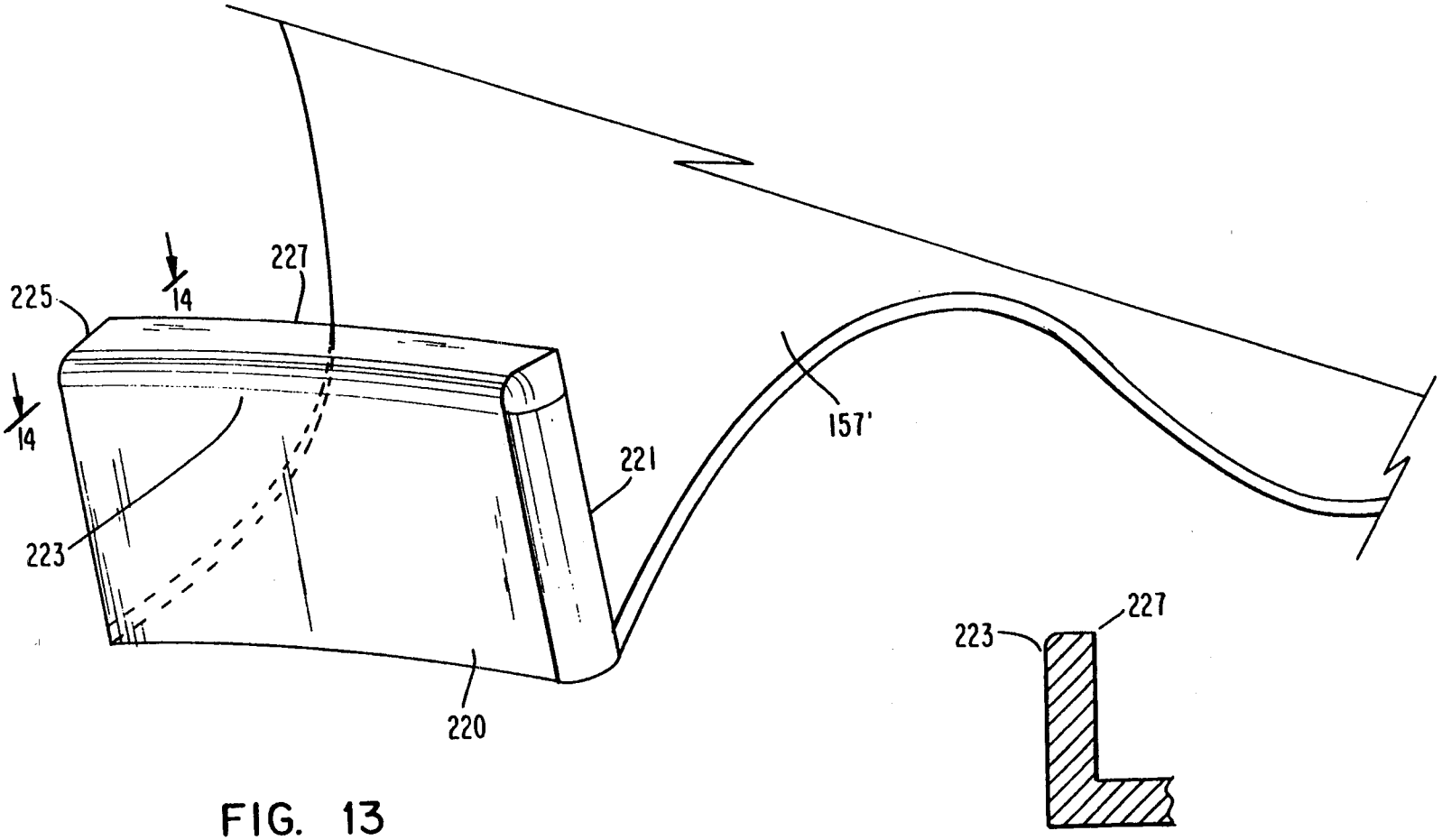
FIG. 13 is another embodiment of a component of the drive cam and locker lever arrangement.
FIG. 14 is a cross-section view along line IVX—IVX of FIG. 13.

In an alternative embodiment, and with reference to FIG. 13, a protrusion 220 is depicted extending outwardly from the lock lever 157'. The protrusion 220 has a fully radiused front 221, a radiused edge 223, a radiused corner 225 and a sharp edge 227. FIG. 14 more clearly depicts the sharp edge 227 and the radiused edge 223.

It should be understood that the protrusion 220 functions in the same manner as the fully radiused post 159 as described above. Specifically, the radiused corner 225 permits the protrusion 220 to ramp out of the through opening 169 via the ramps 171 and 173.

The fully radiused front 221 facilitates rotation of the protrusion 220 when engaged in the through opening 169.

The sharp edge 227 and fully radiused edge 223 interact when the drive cam moves longitudinally when the combination is pushed in. If a correct combination is dialed, the protrusion 220 drops into the slot 161 and into the through opening 169 when the combination dial is released. The sharp edge 227 prevents the protrusion 220 from exiting the through hole 169 until the combination lock is opened.

When an incorrect combination is dialed and the combination dial face is pushed in to translate the drive cam, the protrusion 220 separates from the outer edge 165 of the drive cam. However, since the gates 155 are not aligned to permit the fence 102 to drop therein, the lock lever 95 remains in a raised position. Upon release of the combination dial, the drive cam contacts the radiused edge 223 to lift the protrusion 220 and lock lever upwardly such that the fence 102 is raised off the wheels 153. In this manner an unauthorized user cannot manipulate the combination lock by attempting to detect a position of the gates by the fence contacting the wheel peripheries. It should be understood that the fully radiused post functions in the same manner as described above for the protrusion 220. Of course, other shapes may be utilized for the post or protrusion providing that rounded or radiused surfaces are included thereon to facilitate the movements as described above.

It should be understood that the novel lock lever and drive cam mechanism can be utilized with the above described inventive combination lock mechanisms or used alone in known combination locks. Similarly, the kicker arm-pawl lock mechanism, the number one wheel scrambling lock mechanism and the lock lever and pivoting pawl lock mechanism may be used alone or in various combinations.

Furthermore, although pins have been shown as stops to perform the various functions described above, other types of stops may be utilized. For example, elongated members of other shapes, such as square bars or other shapes capable of remaining stationary can be utilized. Other configurations or arrangements which provide the same motions of movement for the various components as described above may be utilized.

As such, an invention has been disclosed in terms of preferred embodiments thereof which fulfill each and every one of the objects of the present invention as set forth hereinabove and provide new and improved combination lock mechanisms for use with combination dial locks.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. In a combination lock having a lock casing and a lock cover, a combination dial attached to one end of a spindle extending through said lock casing, a drive cam attached to the other end of the spindle, a plurality of wheels rotatably mounted around said spindle, each wheel having a gate, a lock lever having a nose, and a bolt adapted to be extended or retracted by translation of said lock lever, wherein said spindle is adapted to longitudinally translate for checking a combination, the improvement comprising:

a) a kicker arm assembly rotatably mounted within said lock casing;

b) means for translating a longitudinal movement of said spindle into a first rotational movement of said kicker arm assembly; and c) means for transmitting said first rotational movement to one of said wheels adjacent said lock casing such that when the spindle is translated to check the combination, if the combination is incorrect one of said wheels is rotated to scramble said combination.

2. The combination lock of claim 1 wherein said kicker arm assembly and means for translating comprises:

i) a kicker arm having a pair of ramped slots and positioned adjacent said drive cam;

ii) means on said drive cam for engaging said ramped slots to cause a second rotational movement of said kicker arm opposite to said first rotational movement; and iii) means for biasing said kicker arm to impart said first rotational movement to said kicker arm subsequent to said second rotational movement for said rotation of said one wheel.

3. The combination lock of claim 2 wherein said means for transmitting said first rotational movement comprises:

i) a kicker pawl pivotally mounted on an end of said kicker arm; and ii) a geared portion attached to said one wheel, iii) wherein said second rotational movement of said kicker arm permits engagement between said kicker pawl and said geared portion and said first rotational movement of said kicker arm rotates said one wheel.

4. The combination lock of claim 3 comprising stop means for limiting engagement between said geared portion and said kicker pawl.

5. The combination lock of claim 4 wherein said stop means comprises pins extending from said lock casing and arranged to pivot and disengage said kicker pawl from said geared portion.

6. The combination lock of claim 2 comprising stop means for limiting rotation of said kicker arm.

7. The combination lock of claim 6 wherein said stop means comprises a pin extending from said lock cover and designed to travel within a slot in said kicker arm.

8. In a combination lock having a lock casing and a lock cover, a combination dial attached to one end of a spindle extending through said lock casing, a drive cam attached to the other end of the spindle, a plurality of wheels rotatably mounted around said spindle, each wheel having a gate, a lock lever having a nose at a distal end thereof and a fence extending outwardly from said lock lever to engage said gates, and a bolt adapted to be extended or retracted by translation of said lock lever, wherein said spindle is adapted to longitudinally translate for checking a combination, the improvement comprising:

a) a member extending outwardly from said lock lever nose in a direction generally opposite said fence, said member including radiused portions thereon; and b) means on said drive cam for engaging and holding said member when a correct combination is dialed until said combination lock is opened by retraction of said bolt and for releasing said member when said combination lock is to be locked by extension of said bolt.

9. The combination lock of claim 8 wherein said means for engaging and holding comprises:

i) a slotted opening in a portion of a circumferential surface of said drive cam, said slotted opening forming a recess; and ii) a through opening between said recess and a face of said drive cam, said through opening adapted to hold said member until said bolt is retracted and said lock is opened.

10. The combination lock of claim 9 wherein said means for releasing comprises:

i) a first ramp adjacent said through opening for ramping one of said radiused portions of said member out of said through opening into said recess; and ii) a second ramp adjacent said recess for ramping said one radiused portion out of said recess and onto said circumferential surface of said drive cam.

11. In a combination lock having a lock casing and a lock cover, a combination dial attached to one end of a spindle extending through said lock casing, a first drive cam attached to the other end of the spindle, a plurality of wheels rotatably mounted around said spindle, each wheel having a gate, a lock lever having a nose, and a bolt adapted to be extended or retracted by translation of said lock lever, the improvement comprising:

a) a member pivotally mounted to said bolt;

b) a second drive cam attached to one of said plurality of wheels adjacent said lock casing, said second drive cam sized to engage said member when said one of the plurality of wheels rotates to drive said member towards said bolt and hence extend said bolt into a locked position; and c) means on said bolt for permitting extension of said lock lever such that each of said plurality of wheels can rotate to scramble the combination prior to extension of said bolt by engagement between said member and said second drive cam.

12. The combination lock of claim 11 wherein second drive cam is arranged on a face of said one wheel adjacent said lock casing, said second drive cam including a step for engaging said member.

13. The combination lock of claim 11 comprising means for controlling pivoting travel of said member between an inoperative position when said bolt is extended and an operative position when said bolt is retracted.

14. The combination lock of claim 13 wherein said means for controlling comprises a travel spring rigidly attached at one end to said member and positioned at an opposite end between a pair of stops, said stops designed to engage said travel spring to control pivotal movement of said member between said operative and inoperative positions, each of said stops extending outwardly from said lock casing.

15. In a combination lock having a lock casing having a bolt slideway and a lock cover, a combination dial attached to one end of a spindle extending through said lock casing, a drive cam attached to the other end of the spindle, a plurality of wheels rotatably mounted on said spindle, each wheel having a gate, a lock lever having a nose, and a bolt adapted to be extended or retracted by translation of said lock lever, the improvement comprising:

a) means for permitting limited extension of said lock lever without causing extension of said bolt; and b) means pivotally mounted to said bolt for movement between first and second operative positions, for transmitting a force applied to an end face of said bolt when the bolt is extended to said lock casing and said means for transmitting is in said first operative position such that said force is not transmitted to said lock lever and said lock lever is not configured into an inoperable position.

16. The combination lock of claim 15 wherein said means for transmitting a force comprises:

i) a pair of pawls, each pawl pivotally mounted to said bolt for biasing toward a longitudinal axis of said bolt;

ii) a pair of opposing slots, each slot formed in said bolt slideway such that an ear portion of each pawl engages a respective slot in said first operative position when said bolt is extended to permit transmission of said force to said lock casing via each of said pawls.

17. The combination lock of claim 16 wherein said means for permitting limited extension of said lock lever comprises:

i) a plate member connected to an end of said lock lever by a lock lever fastener and having a pawl stop arranged on a distal end thereof; and ii) a slot in said bolt for receiving said plate member, said slot including an opening to receive said lock lever fastener, said opening sized to permit limited travel of said lock lever fastener and said lock lever;

iii) wherein initial extension of said lock lever translates said plate member fully into said slot, and wherein further extension of said lock lever extends said plate member and said bolt such that said pawl stop pivots each of said pawls outwardly toward said stops.

18. In a combination lock having a lock casing having a bolt slideway and a lock cover, a combination dial attached to one end of a spindle extending through said lock casing, a drive cam attached to the other end of the spindle, a plurality of wheels rotatably mounted around said spindle, each wheel having a gate, a lock lever having a fence and a nose, and a bolt adapted to be extended or retracted by translation of said lock lever, wherein said spindle is adapted to longitudinally translate for checking a combination, the improvement comprising:

a) a kicker arm assembly, rotatably mounted within said lock casing and means for translating a longitudinal movement of said spindle into a first rotational movement of said kicker assembly, b) means for transmitting said first rotational movement to one of said wheels adjacent said lock casing such that checking of correct or incorrect combination results in a rotation of said one of said wheels to scramble said combination;

c) a first member pivotally mounted on said bolt;

d) means attached to one of said plurality of wheels adjacent said lock casing for engaging said first member to extend said bolt into a locked position;

e) means on said bolt for permitting extension of said lock lever such that each of said plurality of wheels can rotate to scramble the combination prior to extension of said bolt by engagement between said first member and said means for engaging said first member;

f) a second member having radiused portions extending outwardly from said lock lever nose and opposite said fence;

g) means on said drive cam for engaging and holding said second member when a correct combination is dialed until said combination lock is opened by retraction of said bolt and for releasing said second member when said combination lock is to be locked by extension of said bolt; and h) means for transmitting a force applied to an end face of said bolt when the bolt is extended to said lock casing such that said force is not transmitted to said lock lever and said lock lever is not configured into an inoperable position.

19. The combination lock of claim 18 wherein said kicker arm assembly and means for translating comprises:

i) a kicker arm having a pair of ramped slots and positioned adjacent said drive cam;

ii) means on said drive cam for engaging said ramped slots to cause a second rotational movement of said kicker arm opposite to said first rotational movement;

iii) means for spring biasing said kicker arm to impart said first rotational movement to said kicker arm subsequent to said second rotational movement for said rotation of said one wheel; and said means for transmitting said rotational movement comprises a) a kicker pawl pivotally mounted on an end of said kicker arm; and b) a geared portion attached to said one wheel, c) wherein said second rotational movement permits engagement between said kicker pawl and said geared portion and said first rotational movement of said kicker arm rotates said one wheel.

20. The combination lock of claim 18 wherein said means for engaging and holding comprises:

i) a slotted opening in a portion of a circumferential surface of said drive cam, said slotted opening forming a recess; and ii) a through opening between said recess and a face of said drive cam, said through opening adapted to hold said member until said bolt is retracted and said lock is opened; and said means for releasing comprises;

a) a first ramp adjacent said through opening for ramping one of said radiused portions out of said through opening into said recess; and b) a second ramp adjacent said recess for ramping said one radiused portion out of said recess and onto said circumferential surface of said drive cam.

21. The combination lock of claim 18 wherein said means attached to said one wheel comprises:

a second drive cam arranged on a face of said one wheel adjacent said lock casing, said second drive cam including a step for engaging said member; and means for controlling pivoting travel of said member between an inoperative position when said bolt is extended and an operative position when said bolt is retracted.

22. The combination lock of claim 18 wherein said means for transmitting a force comprises:

i) a pair of pawls, each pawl pivotally mounted to said bolt for biasing toward a longitudinal axis of said bolt;

ii) a pair of opposing slots, each slot formed in said bolt slideway such that an ear portion of each pawl engages a respective slot when said bolt is retracted to permit transmission of said force said lock casing via each of said pawls; and said means for permitting limited extension of said lock lever comprises:

a) a plate member connected to an end of said lock lever by a lock lever fastener and having a pawl stop arranged on a distal end thereof; and b) a slot in said bolt for receiving said plate member, said slot including an opening to receive said lock lever fastener, said opening sized to permit limited travel of said lock lever fastener and said lock lever;

c) wherein initial extension of said lock lever translates said plate member fully into said slot and wherein further extension of said lock lever extends said plate member and said bolt such that said pawl stop pivots each of said pawls outwardly toward said stops.

* * * * *